US009510108B2

(12) United States Patent
Han et al.

(10) Patent No.: US 9,510,108 B2
(45) Date of Patent: Nov. 29, 2016

(54) CIRCUIT MODULE FOR SILICON CONDENSER MICROPHONE

(71) Applicants: Dong Han, Shenzhen (CN); Chua TiongKee, Singapore (SG); Roger Tay, Singapore (SG); Tan Siew Seong, Shenzhen (CN)

(72) Inventors: Dong Han, Shenzhen (CN); Chua TiongKee, Singapore (SG); Roger Tay, Singapore (SG); Tan Siew Seong, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/832,535

(22) Filed: Aug. 21, 2015

(65) Prior Publication Data

US 2016/0173993 A1 Jun. 16, 2016

(30) Foreign Application Priority Data

Dec. 12, 2014 (CN) ..... 2014 1 0767623

(51) Int. Cl.
*H04R 19/04* (2006.01)
*H04R 3/02* (2006.01)

(52) U.S. Cl.
CPC ..... *H04R 19/04* (2013.01); *H04R 3/02* (2013.01); *H04R 2410/03* (2013.01)

(58) Field of Classification Search
CPC ..... H04R 19/04; H04R 3/02; H04R 2410/03
See application file for complete search history.

(56) References Cited

U.S. PATENT DOCUMENTS 8,582,787 B2 * 11/2013 David ..... H03F 3/187 330/252
8,638,249 B2 * 1/2014 Kropfitsch ..... H03G 3/002 329/347
8,913,762 B2 * 12/2014 Steele ..... G01D 3/032 341/110
2010/0254544 A1 * 10/2010 Kimura ..... H04B 15/005 381/94.1
2011/0150243 A1 * 6/2011 Onishi ..... H02M 3/07 381/111
2011/0293115 A1 * 12/2011 Henriksen ..... H03F 1/301 381/111
2014/0010384 A1 * 1/2014 Kanaya ..... H04R 3/00 381/104
2014/0079254 A1 * 3/2014 Kim ..... H04R 3/00 381/174
2014/0119573 A1 * 5/2014 Kropfitsch ..... H03F 1/086 381/120
2015/0071466 A1 * 3/2015 Lasseuguette ..... H03F 1/3205 381/111
2015/0137834 A1 * 5/2015 Steiner ..... H03F 1/34 324/686

* cited by examiner

*Primary Examiner* — Brenda Bernardi
(74) *Attorney, Agent, or Firm* — Na Xu; IPro, PLLC

(57) ABSTRACT

A circuit module for a silicon condenser microphone of the present disclosure includes a transducer, a charge pump, an isolator, a first amplifier, a second amplifier, a reaction circuit, a first bias circuit, and a second bias circuit. The charge pump electrically connects to an input port of the transducer, and an output port of the transducer electrically connects to an input port of the first amplifier via the isolator. An output port of the first amplifier electrically connects to an input port of the second amplifier. The reaction circuit is arranged between the output port of the first amplifier and the input port of the transducer. The isolator isolates the direct-current components of the first electrical signal, and therefore, the oscillations of the direct-current components will not affect the performance of the first amplifier.

10 Claims, 5 Drawing Sheets

CIRCUIT MODULE FOR SILICON CONDENSER MICROPHONE

FIELD OF THE INVENTION

The present invention relates to microphones, more particularly to a circuit module for a silicon condenser microphone.

DESCRIPTION OF RELATED ART

With the rapid development of wireless communication technologies, mobile phones are widely used in daily life. Users require mobile phones to not only have voice function, but also have high quality voice performance. In addition, with the development of mobile multi-media technologies, sounds, like music, voice, are of importance to a device for performing the multi-media functions. As a sound pick-up device, a microphone is a necessary and important component used in a mobile phone to convert sounds to electrical signals for transmitting the sounds to other devices.

Miniaturized silicon microphones have been extensively developed for over sixteen years, since the first silicon piezoelectric microphone reported by Royer in 1983. In 1984, Hohm reported the first silicon electret-type microphone, made with a metallized polymer diaphragm and silicon backplate. And two years later, he reported the first silicon condenser microphone made entirely by silicon micro-machining technology. Since then a number of researchers have developed and published reports on miniaturized silicon condenser microphones of various structures and performance. U.S. Pat. No. 5,870,482 to Loeppert et al reveals a silicon microphone. U.S. Pat. No. 5,490,220 to Loeppert shows a condenser and microphone device. U.S. Patent Application Publication 2002/0067663 to Loeppert et al shows a miniature acoustic transducer. U.S. Pat. No. 6,088,463 to Rombach et al teaches a silicon condenser microphone process. U.S. Pat. No. 5,677,965 to Moret et al shows a capacitive transducer. U.S. Pat. Nos. 5,146,435 and 5,452,268 to Bernstein disclose acoustic transducers. U.S. Pat. No. 4,993,072 to Murphy reveals a shielded electret transducer.

Various microphone designs have been invented and conceptualized by using silicon micro-machining technology. Despite various structural configurations and materials, the silicon condenser microphone consists of four basic elements: a movable compliant diaphragm, a rigid and fixed backplate (which together form a variable air gap capacitor), a voltage bias source, and a pre-amplifier. These four elements fundamentally determine the performance of the condenser microphone. In pursuit of high performance; i.e., high sensitivity, low bias, low noise, and wide frequency range, the key design considerations are to have a large size of diaphragm and a large air gap. The former will help increase sensitivity as well as lower electrical noise, and the later will help reduce acoustic noise of the microphone. The large air gap requires a thick sacrificial layer. For releasing the sacrificial layer, the backplate is provided with a plurality of through holes.

As known, a silicon condenser microphone is also named MEMS (Micro-Electro-Mechanical-System) microphone. A microphone related to the present application generally includes a substrate, a housing forming a volume cooperatively with the substrate, a MEMS die accommodated in the volume, and an ASIC (Application Specific Integrated Circuit) chip received in the volume and electrically connected with the MEMS die.

Conventional MEMS microphones have the disadvantages such as serious power consumption, lower PSRR (Power Supply Rejection Ratio), higher output impedance. Further, the electrical signals from the MEMS die may affect the performance of the amplifier.

Accordingly, an improved circuit module for a silicon condenser microphone enabling lower power consumption, higher PSRR, and lower output impedance is correspondingly desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment.

Figure 1:
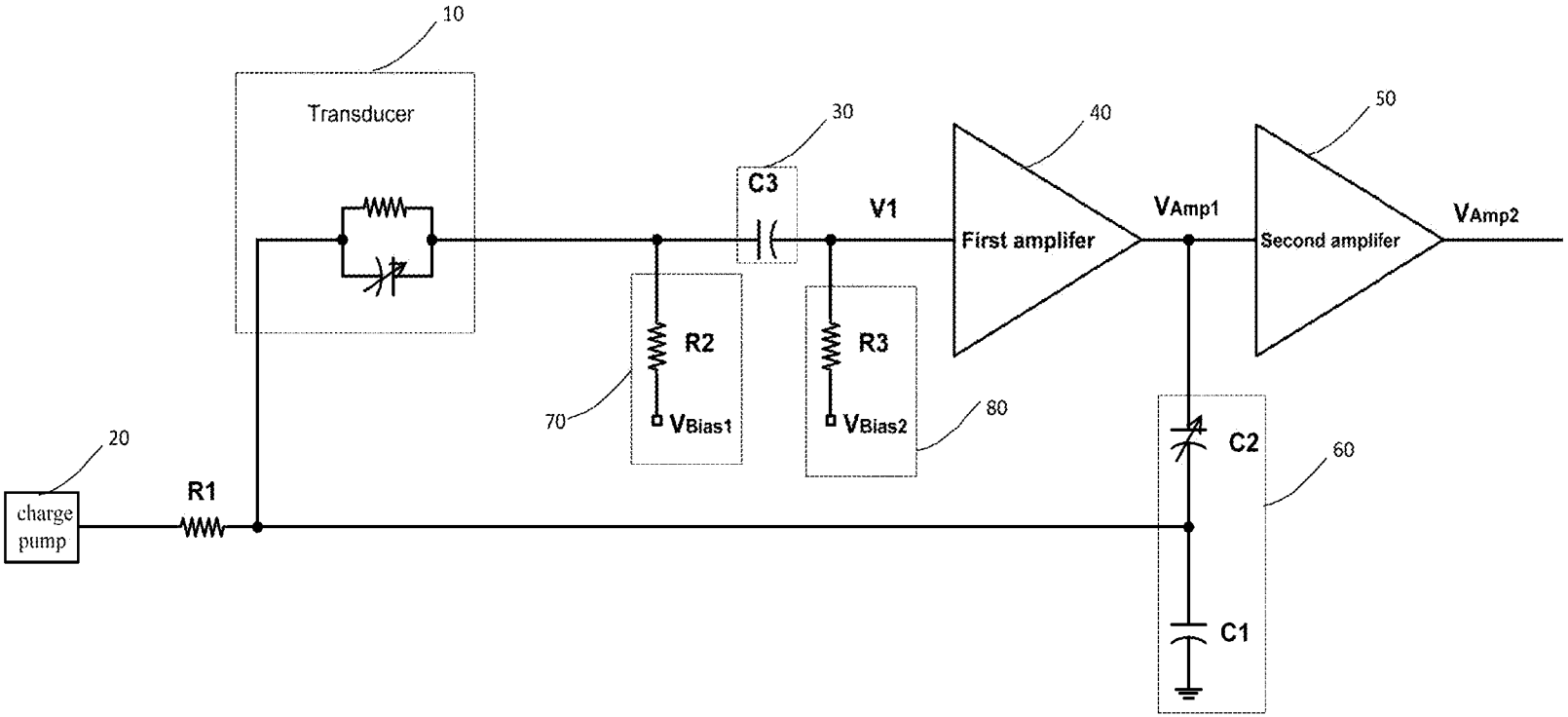
FIG. 1 is an illustrative modular diagram of a circuit module for a silicon condenser microphone in accordance with an exemplary embodiment of the present disclosure.
Figure 5:
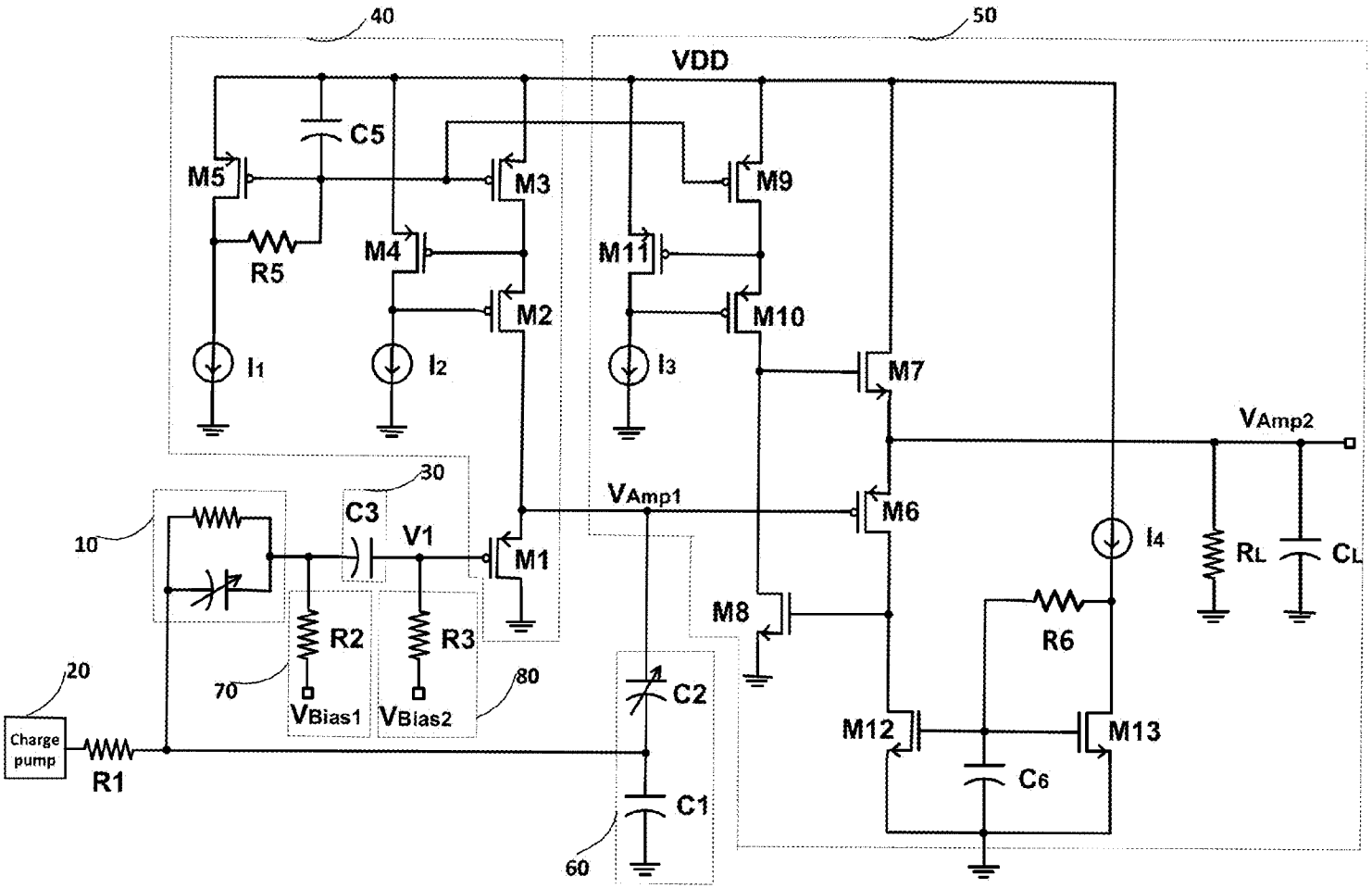
FIG. 5 is a detailed circuit diagram of the circuit module in FIG. 1.

Referring to FIGS. 1 and 5, a circuit module for a silicon condenser microphone of the present disclosure includes a transducer 10, a charge pump 20, an isolator 30, a first amplifier 40, a second amplifier 50, a reaction circuit 60, a first bias circuit 70, and a second bias circuit 80.

The charge pump 20 electrically connects to an input port of the transducer 10 via a first resistance R1, and an output port of the transducer 10 electrically connects to an input port of the first amplifier 40 via the isolator 30. An output port of the first amplifier 40 electrically connects to an input port of the second amplifier 50. The reaction circuit 60 is arranged between the output port of the first amplifier 40 and the input port of the transducer 10. A bias point of the first bias circuit 70 is arranged between the output port of the transducer 10 and the isolator 30 for providing the transducer with working voltage cooperatively with the charge pump 20. A bias point of the second bias circuit 80 is arranged between the isolator and the input port of the first amplifier 40 for providing the first amplifier 40 with bias voltage. The charge pump 20 is used for providing the transducer 10 with high voltage.

The first bias circuit 70 includes a second resistance R2 and a first bias voltage source $V_{bias1}$ series connected to the second resistance R2. One end of the second resistance R2 electrically connects to the output port of the transducer 10, and another end of the second resistance R2 electrically connects to the first bias voltage source $V_{bias1}$. Alternatively and optionally, said another end of the second resistance R2 can directly grounded.

The second bias circuit 80 includes a third resistance R3 and a second bias voltage source $V_{bias2}$ series connected to the third resistance R3. One end of the third resistance R3 electrically connected to the input port of the first amplifier 40, and another end of the third resistance R3 electrically connects to the second bias voltage source $V_{bias2}$.

The reaction circuit 60 includes a variable capacitor C2 and a first capacitor C1 series connected to the variable capacitor C2. One end of the variable capacitor C2 electrically connects to the output port of the first amplifier 40, and another end of the variable capacitor C2 electrically connects to a point between the first resistance R1 and the input port of the transducer 10. One end of the first capacitor C1 electrically connects to the variable capacitor C2, and another end thereof connects to the ground. Thus, the first capacitor C1 and the first resistance R1 cooperatively form a first low-pass filter for filtering the noises from the charge pump 20. In this embodiment, the isolator 30 is an alternating-current coupling capacitor C3.

Detailed working principle of the silicon condenser microphone using the circuit module described above will be described as follows.

High voltage provided by the charge pump, together with the bias voltage provided by the first bias circuit 70, drives the transducer 10 to work at a normal status and output a first electrical signal V1. Direct-current components of the first electrical signal V1 is isolated by the alternating-current coupling capacitor C3, and alternating-current components of the first electrical signal V1 flow into the first amplifier 40. The second bias circuit 80 provides the first amplifier 40 with bias voltage and makes the first amplifier work at the normal status. After receiving the first electrical signal V1, the first amplifier 40 outputs a second electrical signal $V_{Amp1}$. The second electrical signal $V_{amp1}$ flows into the second amplifier 50, and at the same time flows into the input port of the transducer 10 via the reaction circuit 60. By virtue of the variable capacitor C2 in the reaction circuit 60, output sensitivities of the silicon condenser microphone is adjustable. Because the direct-current components of the first electrical signal V1 are isolated by the isolator 30, and the second bias circuit 80 provides optimized bias voltage to the first amplifier 40, higher AOP (Acoustic Overload Point) and better PSRR are accordingly achieved. In this embodiment, the isolator 30 isolates the direct-current components of the first electrical signal V1, and therefore, the changes or oscillations of the direct-current components caused by manufacturing process or variable temperature will not affect the performance of the first amplifier 40.

Figure 2:
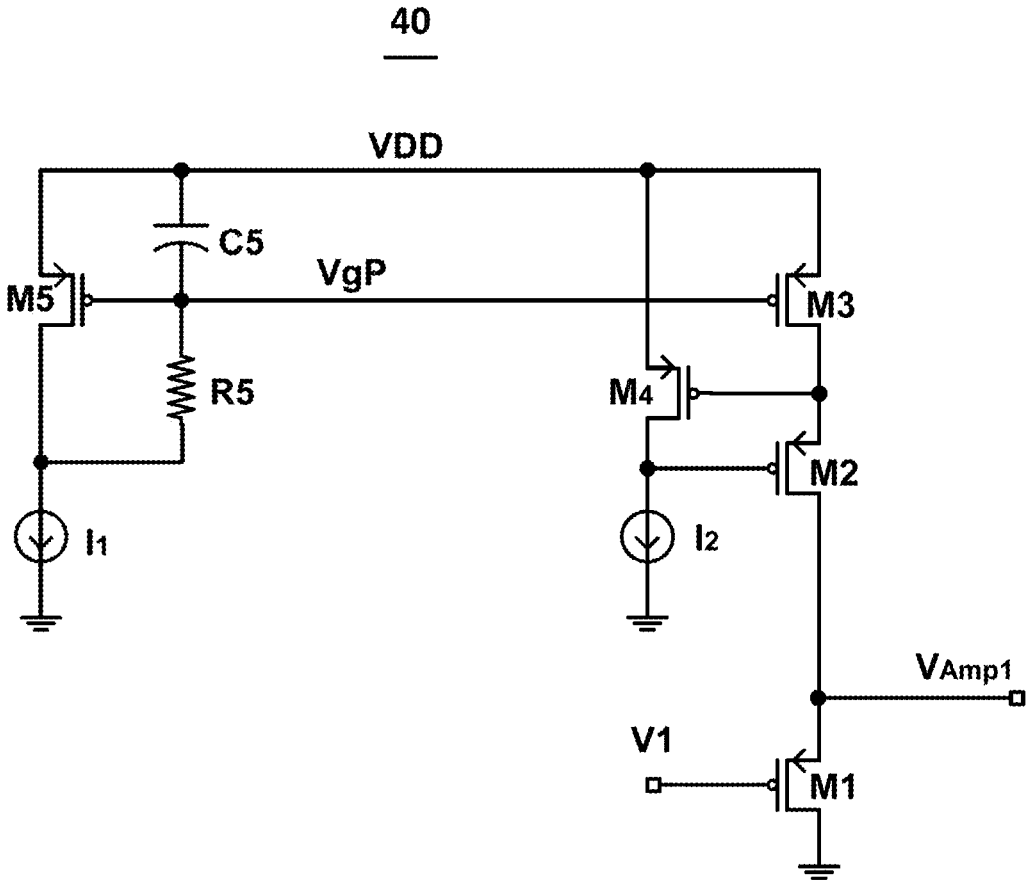
FIG. 2 is a circuit diagram of a first amplifier in FIG. 1.

Referring to FIG. 2, the first amplifier 40 includes a first transistor M1, a second transistor M2, a third transistor M3, a fourth transistor M4, and a fifth transistor M5. Further, the first amplifier 40 comprises a first reference current source I1 for providing reference current, a second reference current source I2 for providing reference current, and a second low-pass filter. The gate electrode of the first transistor M1 serves as the input port of the first amplifier 40 for receiving the direct-current components of the first electrical signal V1 from the transducer 10 and the bias voltage provided by the second bias circuit 80 to drive the first amplifier 40. The source electrode of the first transistor M1 serves as the output port of the first amplifier 40 for outputting the second electrical signal $V_{Amp1}$. The drain electrode of the first transistor M1 is grounded. The drain electrode of the second transistor M2 connects to the source electrode of the first transistor M1, the source electrode of the second transistor M2 connects to the drain electrode of the third transistor M3, and the gate electrode of the second transistor M2 connects to the drain electrode of the fourth transistor M4. The source electrode of the third transistor M3 connects to the power voltage VDD, and the gate electrode of the third transistor M3 connects to the gate electrode of the fifth transistor M5 for forming a first co-gate current mirror. The source electrode of the fourth transistor M4 connects to the power voltage VDD, the gate electrode of the fourth transistor M4 connects to the drain electrode of the third transistor M3, and the drain electrode of the fourth transistor M4 is grounded via the second reference current source I2. The source electrode of the fifth transistor M5 connects to the power voltage VDD, and the drain electrode of the fifth transistor M5 connects to the first reference current source I1 for being grounded. The second low-pass filter is arranged between the gate electrode and the drain electrode of the fifth transistor M5 for filtering the noises from the fifth transistor M5 and the first reference current source I1, thereby decreasing the noises of the second electrical signal $V_{Amp1}$. Optionally, the first, second, third, fourth, fifth transistors are all PMOS transistors.

In this embodiment, the current ratio of the first co-gate current mirror is 1:N. Without the second low-pass filter, the noises from the first reference current source I1 and the fifth transistor M5 will be coupled to the second electrical signal $V_{Amp1}$. For decreasing the coupling ratio, N needs to be smaller, for example, N=4. For obtaining noises from the second electrical signal $V_{Amp1}$, the first reference current source I1 needs to be greater, for example 5 μA for decreasing the output noises from the first reference current source I1. The first transistor M1 also needs greater drain current, for example 20 μA for decreasing the noises from the second electrical signal $V_{Amp1}$. The noises from the first reference current source I1 and the fifth transistor M5, however, have been filtered by the second low-pass filter. Therefore, the increased N will not increase the noises from the second electrical signal $V_{Amp1}$. Thus, if N is greater, e.g. 50, the first reference current source I1 may provide smaller current, e.g. 0.1 μA. Because the second electrical signal $V_{Amp1}$ is not coupled with the noises from the first reference current source and the fifth transistor M5, the drain current of the first transistor M1 may be reduced, e.g. 5 μA thereby reducing the power consumption. The usage of the second low-pass filter will reduce the power consumption but can still obtain the same noises.

In the embodiment, the second low-pass filter includes a second capacitor C5 arranged between the source electrode and the gate electrode of the fifth transistor M5, and a fifth resistance R5 arranged between the gate electrode and the drain electrode of the fifth transistor M5. The fifth resistance R5 may be a normal constant resistance, and may also be a resistance grid formed by one or more PMOS, NMOS, or diode. Again, the second capacitor C5 may be a normal constant capacitor, and may also be a PMOS capacitor, an NMOS capacitor, or a diode capacitor.

In the embodiment described above, the second transistor M2, the fourth transistor M4, and the second reference current source I2 cooperatively form a negative reaction circuit, which increases the output impedance from the drain electrode of the second transistor M2 to the power voltage VDD, and further improves the PSRR of the second electrical signal $V_{Amp1}$.

Figure 3:
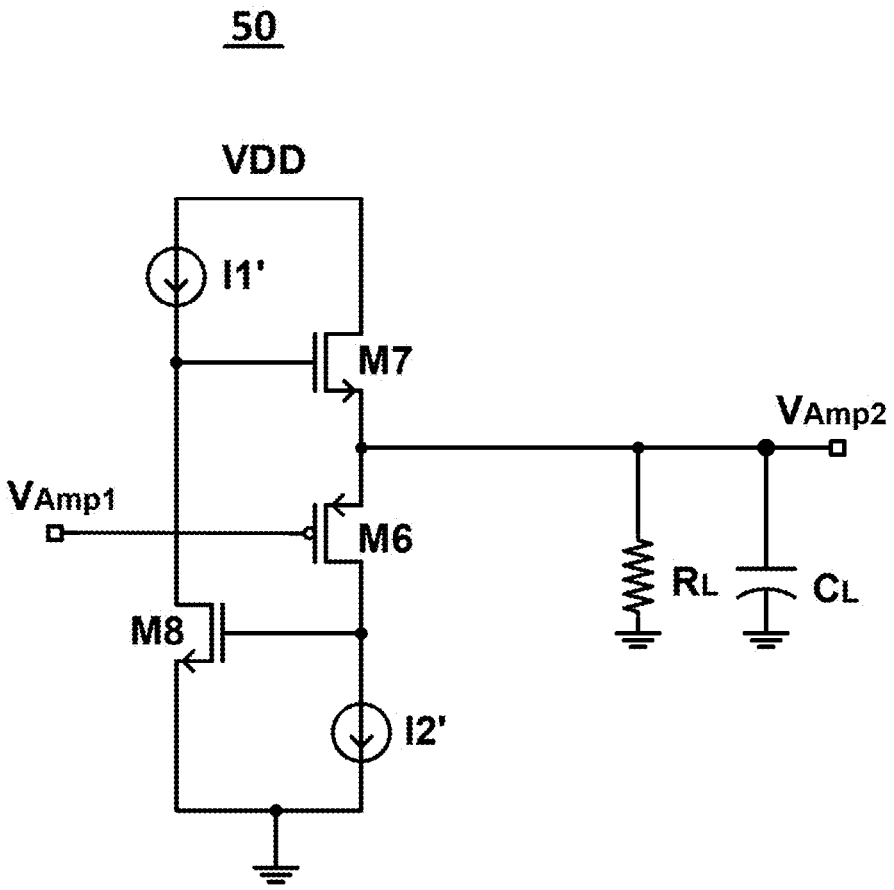
FIG. 3 is a circuit diagram of a second amplifier in FIG. 1.

Referring to FIG. 3, an optional circuit of the second amplifier 50 is shown. The second amplifier 50 includes a sixth transistor M6, a seventh transistor M7, an eighth transistor M8, a first current source I1', and a second current source I2'. The gate electrode of the sixth transistor M6 serves as the input port of the second amplifier 50 for receiving the second electrical signal $V_{Amp1}$ The source electrode of the sixth transistor M6 serves as the output port of the second amplifier 50 for outputting a third electrical signal $V_{Amp2}$ processed by the second amplifier 50. The drain electrode of the sixth transistor is grounded via the second current source I2'. The source electrode of the seventh transistor M7 connects to the source electrode of the sixth transistor M6, the drain electrode of the seventh transistor M7 connects to the power voltage VDD. The gate electrode of the seventh transistor connects to the drain electrode of the eighth transistor M8. The gate electrode of the eighth transistor M8 connects to the drain electrode of the sixth transistor M6.

The source electrode of the eighth transistor M8 is grounded. And the drain electrode of the eighth transistor M8 connects to the power voltage VDD via the first current source I1'. The output port of the second amplifier 50 further includes fictitious loads $R_L$, $C_L$. The output impedance $R_{out}$ of the second amplifier 50 can be calculated by the following formula:

$$R_{out} = \frac{1}{g_{M6}} \times \frac{1}{g_{M8} \times R_0}$$

Wherein, $g_{M6}$ is the conductance of the sixth transistor M6;

gM8 is the conductance of the eighth transistor M8;

$R_0$ is the output impedance of the first current source I1'.

Figure 4:
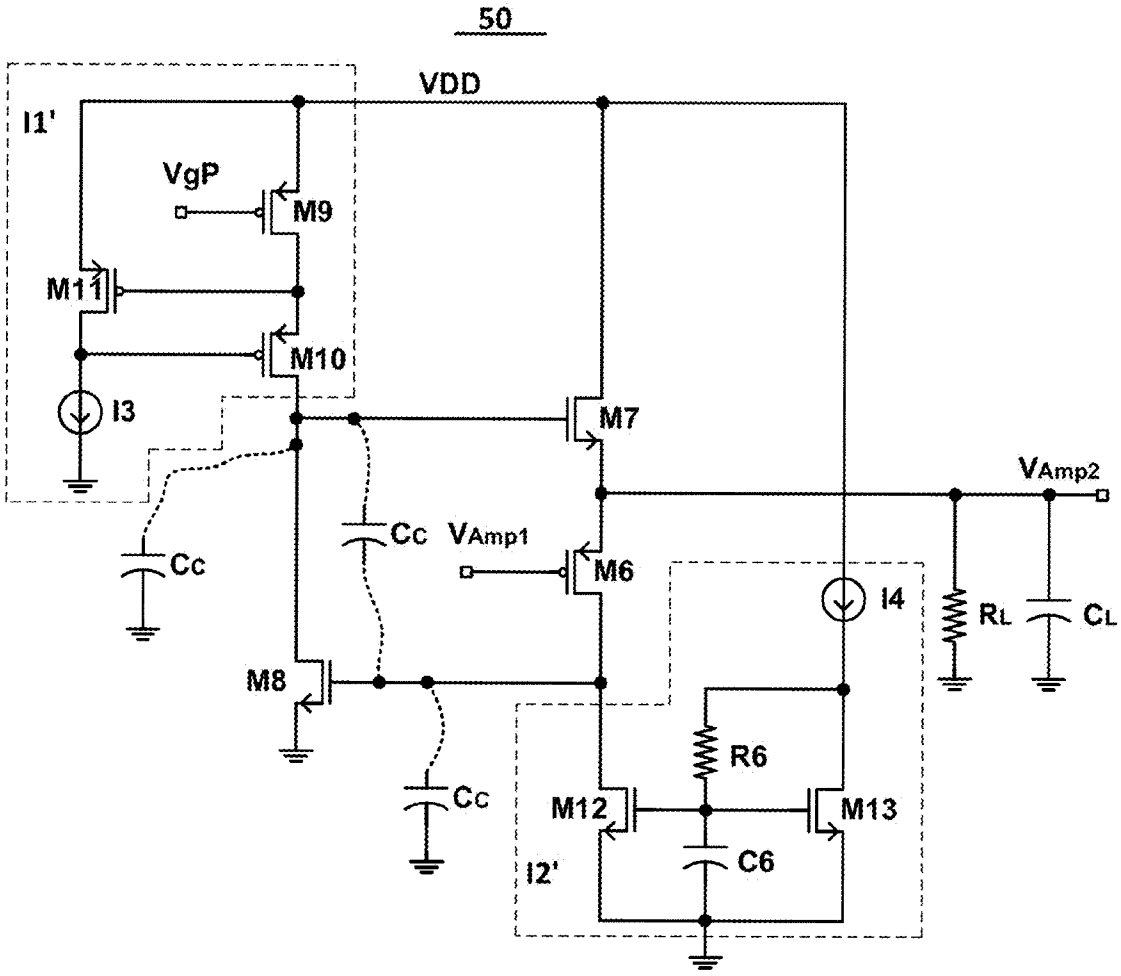
FIG. 4 is an alternative circuit diagram of the second amplifier in FIG. 1.

Referring to FIGS. 4-5, an alternative circuit of the second amplifier 50 is shown. What is different from the circuit of the second amplifier described above is that the first and second current sources are provided with different circuits. In this alternation, the first current source IV includes a ninth transistor M9, a tenth transistor M10, an eleventh transistor M11, and a third reference current source I3. The drain electrode of the tenth transistor M10 connects to the drain electrode of the eighth transistor M8, the gate electrode of the tenth transistor M10 connects to the drain electrode of the eleventh transistor M11, and the source electrode of the tenth transistor M10 connects to the drain electrode of the ninth transistor M9. The source electrode of the ninth transistor M9 connects to the power voltage VDD, the gate electrode connects to the gate electrode of the fifth transistor M5 for forming a second co-gate current mirror. The source electrode of the eleventh transistor M11 connects to the power voltage VDD, and the drain electrode of the eleventh transistor M11 is grounded via the third reference current source I3. By this configuration, the eleventh transistor M11, the tenth transistor M10, and the third reference current source cooperatively form a negative reaction circuit for increasing the output impedance from the drain electrode od the tenth transistor M10 to the power voltage VDD. Thus, the PSRR of the seventh transistor M7 is accordingly improved.

The second current source I2' includes a twelfth transistor M12, a thirteenth transistor M13, a fourth reference current source I4 and a third low-pass filter. The drain electrode of the twelfth transistor M12 connects to the drain electrode of the sixth transistor M6, the source electrode of the twelfth transistor M12 is grounded, and the gate electrode connects to the gate electrode of the thirteenth transistor M13. The source electrode of the thirteenth transistor M13 is grounded, the drain electrode connects to the power voltage VDD via the fourth reference current source I4. The third low-pass filter is arranged between the drain electrode and the gate electrode of the thirteenth transistor M13 for filtering the noises from the thirteenth transistor M13 and the fourth reference current source I4, thereby decreasing the noises from the third electrical signal $V_{Amp2}$.

The third low-pass filter includes a sixth resistance R6 arranged between the drain electrode and the gate electrode of the thirteenth transistor M13, and a third capacitor C6 arranged between the gate electrode and the source electrode of the thirteenth transistor M13. In this alternation, the seventh transistor M7, the eighth transistor M8, and the tenth transistor M10 cooperatively form the negative reaction circuit. By virtue of adding a capacitor Cc, frequency compensation to the negative reaction circuit is achieved. The capacitor Cc could be arranged as follows:

(1) the capacitor Cc could be arranged between the gate electrode of the seventh transistor M7 and the gate electrode of the eighth transistor M8;

(2) the capacitor Cc could be arranged with one end thereof connected to the drain electrode of the eighth transistor, and the other end thereof grounded; or (3) the capacitor Cc could be arranged with one end thereof connected to the gate electrode of the eighth transistor, and the other end thereof grounded.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A circuit module for a silicon condenser microphone, comprising:

a charge pump;

a first amplifier;

a second amplifier with an input port thereof connecting to an output port of the first amplifier;

a transducer with an input port thereof connecting to the charge pump and an output port thereof connecting to an input port of the first amplifier;

a reaction circuit connected between the output port of the first amplifier and the input port of the transducer;

a first bias circuit for providing working voltage to the transducer cooperatively with the charge pump;

an isolator connected between the output port of the transducer and the input port of the first amplifier for isolating direct-current components of a first electrical signal produced by the transducer;

a second bias circuit for providing bias voltage to the first amplifier.

2. The circuit module for a silicon condenser microphone as described in claim 1, wherein the isolator is an alternating-current coupling capacitor.

3. The circuit module for a silicon condenser microphone as described in claim 1 further including a first resistance arranged between the input port of the transducer and the charge pump, wherein the reaction circuit has one end connected between the first resistance and the input port of the transducer and another end connected to the output port of the first amplifier.

4. The circuit module for a silicon condenser microphone as described in claim 3, wherein the reaction circuit includes a variable capacitor and a first capacitor series connected to the variable capacitor, one end of the variable capacitor electrically connecting to the output port of the first amplifier, and another end of the variable capacitor electrically connecting to a point between the first resistance and the input port of the transducer, one end of the first capacitor electrically connecting to the variable capacitor, and another end thereof grounded.

5. The circuit module for a silicon condenser microphone as described in claim 1, wherein the first amplifier includes a first transistor, a second transistor, a third transistor, a fourth transistor, a fifth transistor, a first reference current source for providing reference current, a second reference current source for providing reference current, and a second low-pass filter, and wherein the gate electrode of the first transistor serves as the input port of the first amplifier for receiving direct-current components of the first electrical signal from the transducer and the bias voltage provided by the second bias circuit to drive the first amplifier;

the source electrode of the first transistor serves as the output port of the first amplifier for outputting a second electrical signal, and the drain electrode of the first transistor is grounded;

the drain electrode of the second transistor connects to the source electrode of the first transistor, the source electrode of the second transistor connects to the drain electrode of the third transistor, and the gate electrode of the second transistor connects to the drain electrode of the fourth transistor;

the source electrode of the third transistor connects to the power voltage, and the gate electrode of the third transistor connects to the gate electrode of the fifth transistor for forming a first co-gate current mirror;

the source electrode of the fourth transistor connects to the power voltage, the gate electrode of the fourth transistor connects to the drain electrode of the third transistor, and the drain electrode of the fourth transistor is grounded via the second reference current source;

the source electrode of the fifth transistor connects to the power voltage, and the drain electrode of the fifth transistor connects to the first reference current source for being grounded;

the second low-pass filter is arranged between the gate electrode and the drain electrode of the fifth transistor for filtering the noises from the fifth transistor and the first reference current source.

6. The circuit module for a silicon condenser microphone as described in claim 5, wherein the first transistor, the second transistor, the third transistor, the fourth transistor and the fifth transistor are PMOS transistors.

7. The circuit module for a silicon condenser microphone as described in claim 6, wherein the second low-pass filter includes a second capacitor arranged between the source electrode and the gate electrode of the fifth transistor, and a fifth resistance arranged between the gate electrode and the drain electrode of the fifth transistor.

8. The circuit module for a silicon condenser microphone as described in claim 1, wherein the second amplifier includes a sixth transistor, a seventh transistor, an eighth transistor, a first current source, and a second current source, and wherein the gate electrode of the sixth transistor serves as the input port of the second amplifier for receiving the second electrical signal;

the source electrode of the sixth transistor serves as the output port of the second amplifier for outputting a third electrical signal processed by the second amplifier;

the drain electrode of the sixth transistor is grounded via the second current source;

the source electrode of the seventh transistor connects to the source electrode of the sixth transistor;

the drain electrode of the seventh transistor connects to the power voltage;

the gate electrode of the seventh transistor connects to the drain electrode of the eighth transistor;

the gate electrode of the eighth transistor connects to the drain electrode of the sixth transistor;

the source electrode of the eighth transistor is grounded.

9. The circuit module for a silicon condenser microphone as described in claim 8, wherein the first current source includes a ninth transistor, a tenth transistor, an eleventh transistor, and a third reference current source, and wherein the drain electrode of the tenth transistor connects to the drain electrode of the eighth transistor;

the gate electrode of the tenth transistor connects to the drain electrode of the eleventh transistor, and the source electrode of the tenth transistor connects to the drain electrode of the ninth transistor;

the source electrode of the ninth transistor connects to the power voltage, and the gate electrode of the ninth transistor connects to the gate electrode of the fifth transistor for forming a second co-gate current mirror;

the source electrode of the eleventh transistor connects to the power voltage, and the drain electrode of the eleventh transistor is grounded via the third reference current source.

10. The circuit module for a silicon condenser microphone as described in claim 9, wherein the second current source includes a twelfth transistor, a thirteenth transistor, a fourth reference current source and a third low-pass filter, and wherein the drain electrode of the twelfth transistor connects to the drain electrode of the sixth transistor, the source electrode of the twelfth transistor is grounded, and the gate electrode of the twelfth transistor connects to the gate electrode of the thirteenth transistor;

the source electrode of the thirteenth transistor is grounded, and the drain electrode of the thirteenth transistor connects to the power voltage via the fourth reference current source;

the third low-pass filter is arranged between the drain electrode and the gate electrode of the thirteenth transistor for filtering the noises from the thirteenth transistor and the fourth reference current source, thereby decreasing the noises from the third electrical signal.

* * * * *